US007931541B2

(12) United States Patent
Rhodes

(10) Patent No.: US 7,931,541 B2
(45) Date of Patent: Apr. 26, 2011

(54) GOLF GRIP TRAINING TOOL

(76) Inventor: Stephen B. Rhodes, Roswell, NM (US)

( * ) Notice: Subject to any disclaimer, the term of this patent is extended or adjusted under 35 U.S.C. 154(b) by 0 days.

(21) Appl. No.: 12/654,398

(22) Filed: Dec. 18, 2009

(65) Prior Publication Data

US 2010/0167829 A1 Jul. 1, 2010

Related U.S. Application Data

(60) Provisional application No. 61/203,574, filed on Dec. 22, 2008.

(51) Int. Cl.
*A63B 69/36* (2006.01)

(52) U.S. Cl. ..... 473/201; 473/206; 473/409

(58) Field of Classification Search ..... 473/201, 473/203, 204, 206, 219, 226, 314, 325, 409
See application file for complete search history.

(56) References Cited

U.S. PATENT DOCUMENTS

| | | | | |
|---|---|---|---|---|
| 1,126,208 | A | 1/1915 | Hayford | |
| 1,664,257 | A * | 3/1928 | McCullough | 473/203 |
| 2,091,512 | A | 8/1937 | Marsh | |
| 2,472,978 | A * | 6/1949 | Mahon | 473/325 |
| 2,690,338 | A | 9/1954 | De Brocke | |
| 3,528,660 | A * | 9/1970 | Kategian | 473/296 |
| 3,693,978 | A * | 9/1972 | East | 473/314 |
| 5,026,063 | A * | 6/1991 | Rhodes | 473/256 |
| 5,163,685 | A | 11/1992 | Rhodes | |
| 5,215,307 | A * | 6/1993 | Huffman | 473/409 |
| 5,348,303 | A | 9/1994 | Swissheim | |
| 5,427,376 | A | 6/1995 | Cummings et al. | |
| 6,022,278 | A | 2/2000 | Vela | |
| D477,647 | S | 7/2003 | Kim | |
| 6,656,054 | B2 | 12/2003 | Ulrich | |
| 7,530,898 | B2 | 5/2009 | Pinkart | |
| 7,708,648 | B2 * | 5/2010 | Brunton et al. | 473/206 |
| 2002/0187845 | A1 | 12/2002 | Kim | |

* cited by examiner

*Primary Examiner* — Nini Legesse
(74) *Attorney, Agent, or Firm* — Welsh Flaxman & Gitter LLC

(57) ABSTRACT

A golf grip training tool utilized on a simulated golf club of reduced length. An abutment is angularly placed on the end of the shaft of the golf club and indicia relating to the placement of the golfer's thumbs and index fingers are attached thereto. Utilizing the abutment and the indicia, the golfer would be able to properly place his or her hands on the upper shaft or handle of the golf club to learn the proper grip.

7 Claims, 5 Drawing Sheets

GOLF GRIP TRAINING TOOL

CROSS-REFERENCE TO RELATED APPLICATION(S)

The present invention claims the priority of U.S. Provisional Patent Application Ser. No. 61/203,574, filed on Dec. 22, 2008, and incorporates all of the information contained therein by reference.

FIELD OF THE INVENTION

The present invention is directed to a golf grip training aid.

BACKGROUND OF THE INVENTION

The correct hold on a golf grip is not natural or intuitive. Rather, considerable time is taken for a golfer to learn the correct hold on a golf grip and to repeatedly grip the golf club correctly prior to swinging the golf club. The correct hold is an important foundation of a correct golf swing and the sooner that it would become comfortable and instinctive, the sooner that it would become a permanent asset rather than a recurring problem to overcome for the golfer.

The prior art is replete with a multitude of patents directed to teaching a correct golf grip. For example, U.S. Pat. No. 5,163,685, entitled Sports Grip Training Device, was issued to the inventor of the present invention and is incorporated by reference. This patent describes a sports grip training device having application for a number of sports implements including a golf club. This device included an abutment member which is adapted to be secured, for example, to the end of a golf club shaft. In use, the little finger and back edge of a golfer's upper hand is engaged with the abutment member allowing the golfer's hand to be set at the proper angular orientation on the golf club. While the '685 patent does assist the golfer in endeavoring to formulate the proper grip, since there are no markings on the shaft adjacent to the golfer's hands when the golf club is gripped, it is sometimes difficult to properly orient the golfer's hands when the golfer engages the handle portion of the golf club shaft.

A number of patents are directed to placing various indicia near the top end of a standard golf club shaft. For example, U.S. Pat. No. 5,427,376, issued to Cummings et al, describes a golf grip having various indicia applied to the exterior surface of the top shaft of a golf club. The primary indicia marking, preferably is green, includes a first indicia marking 36 showing the proper placement of one of the golfer's thumbs, a second indicia 38 showing the proper placement of the second thumb, and a third indicia 40 showing the proper placement of the golfer's fingers. However, without the utilization of the abutment described in U.S. Pat. No. 5,163,685, it is difficult to properly orient the golfer's hands. Additionally, it is noted that the indicia is applied to the shaft of a standard golf club.

U.S. Pat. No. 5,348,303, issued to Swissheim, details a golf club grip provided with a first marker 14 in the shape of a diamond defining the position of one thumb of the golfer's hand, as well as a second marker 15 also in the shape of a diamond defining the position between the thumb and forefinger of the golfer's second hand.

U.S. Pat. No. 2,091,512, issued to Marsh, discusses a grip for a golf club including an imprint 4 conforming to the position of the thumb of the right hand of a golfer and an imprint 5 conforming to the thumb of the left hand of the golfer.

Finally, U.S. Pat. No. 6,656,054, issued to Ulrich, shows a golf grip having a hand placement guide comprising a sinuous surface pattern 20 extending from the upper portion 24 of the grip 10 to a lower portion 26.

However, the aforementioned Swissheim, Marsh and Ulrich patents are employed on a standard golf club and do not utilize the abutment described in U.S. Pat. No. 5,163,685.

SUMMARY OF THE INVENTION

The deficiencies of the prior art are addressed by the present invention which is directed to a device for assisting a golfer in producing the proper golf grip. An indicia is provided on the shaft of a practice golf club which is reduced in length than a standard golf club. The indicia includes a longitudinal line extending for a portion of the shaft of the golf practice device as well as indicia utilized to assist the golfer in properly placing his or her thumbs and forefingers on the shaft of the golf practice device. An abutment is placed at the end of the shaft which would also assist the golfer in properly placing his or her hand on the shaft.

The present invention also describes the proper method in assisting the golfer in placing of their hands on the shaft of the practice device. The longitudinal line and the various indicia would assist in this process. Thereafter, the golfer would, by utilizing the practice device described in this application as well as utilizing the described method would become familiar with the proper placement of their hand on the shaft of the golf club prior to swinging of the club. Thereafter, the golfer, when utilizing a standard club without the abutment and the indicia applied to the top of the shaft, the golfer would still be able to properly and comfortably grip the golf club, allowing the golfer to produce a proper swing.

Additionally, it is important to note that the use of the abutment and indicia on the shaft of a reduced length golf club would result in a considerable savings in cost rather than removably attaching the abutment and indicia to standard golf clubs, and allow the golfer to practice the correct grip in a confined environment.

BRIEF DESCRIPTION OF THE DRAWINGS

Further objects and advantages of the present invention may be seen by reading the following detailed description in conjunction with the drawings in which.

DETAILED DESCRIPTION OF THE PRESENT INVENTION

The present invention is directed to an apparatus as well as method of allowing a golfer to properly grip a golf club. Although the present invention will be described with respect to a right handed golfer, it would have equal applicability to be used by a left handed golfer who would mirror the positions of the right handed golfer as the golf grip training tool and the method for using this tool would be explained. With this in mind, the phrase "top hand" refers to the hand that is on top when holding a club at the addressed position for a right handed golfer during a regular golf shot as illustrated with respect to FIG. 15. While taking the grip, the "top hand" is actually lower than the second hand when the club head is pointing upwards, which is the manner in which the grip is taken while practicing with the present invention. Therefore, the "top" or "upper" hand for a right handed golfer refers to the golfer's left hand. Consequently, the "bottom" or "lower" hand refers to the right hand of a right handed golfer. As can be appreciated, the "top" or "upper" hand for a left handed golfer refers to the golfer's right hand and the "bottom" or "lower" hand refers to the left hand. The term "leading" hand refers to that hand that is leading, or closer to the target when the ball is being hit during an actual golf shot. The "trailing" hand is the hand that is trailing in relation to the target when the ball is being hit by the golfer.

Figure 1:
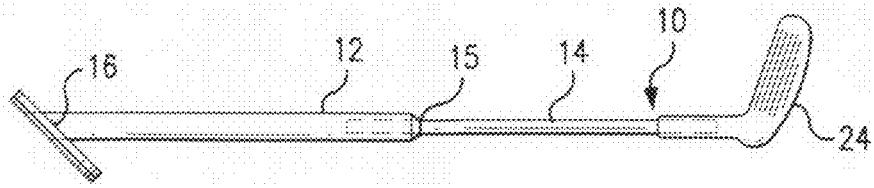
FIG. 1 is a side view of the golf grip training tool of the present invention.
Figure 2:
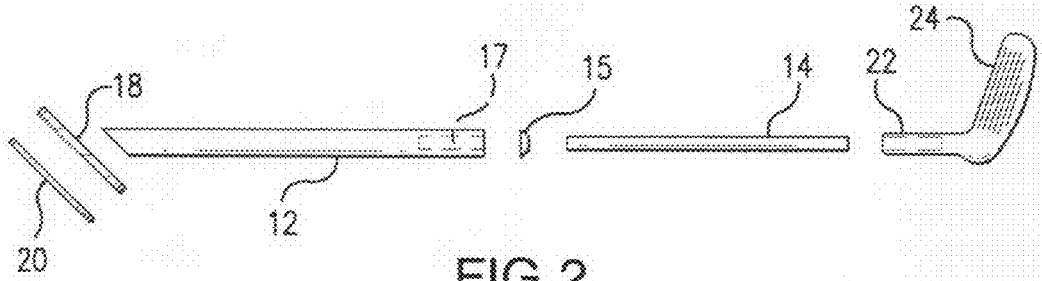
FIG. 2 is an exploded view of the golf grip training tool shown in FIG. 1.

With this in mind, attention is now directed to FIGS. 1-4 which show various features of the golf grip training tool 10. The golf grip training tool includes an upper shaft or dowel 12 which is connected to a lower shaft 14. A golf club head 24 including a simulated hitting surface is connected to the lower shaft 14 by a housel 22. An oval or elliptical abutment plate 16 is attached to the top end of the upper shaft or dowel 12. As shown in FIG. 2, the plate 16 can be constructed from two separate pieces 18 and 20. Alternatively, the abutment plate 16 can be formed from a single piece of material. Piece 18 could be a ¼ inch hardboard and piece 20 could be a ⅛ inch hardboard. These pieces are attached to one another, such as by glue to form the oval or elliptical abutment plate 16. The top end of the shaft 12 which can be constructed from a dowel is cut at an angle and the abutment 16 is secured to this end such as by glue. Although FIG. 1 shows that the angle of the end of the upper shaft or dowel 12 to be 45°, the abutment 16 can be secured to this end at a range of angles such as between 40° and 50°.

The bottom end of the upper shaft or dowel 12 is attached to the lower shaft 14 by various methods. For instance, a hole 17 can be formed at the lower end of the upper shaft or dowel 12 and one end of the lower shaft 14 can be screwed into the hole 17 or affixed into the hole by glue or cement. A rubber slip joint washer 15 can be provided between the upper shaft or dowel 12 and the lower shaft 14. The second end of the lower shaft 14 is inserted into the housel 22 and is affixed thereto by glue or by screwing that end of the lower shaft 14 into the housel 22.

As illustrated in FIGS. 1 and 2, the diameter of the upper shaft 12 is greater than the diameter of the lower shaft 14. For example, the diameter of the upper shaft or dowel 12 can be ¾ of an inch and the diameter of the lower shaft 14 can be ⅜ of an inch. For ease of use, the total length of the golf grip training tool 10 is marketably less than the typical length of a standard golf club. For example, the total length of the training aid 12 including the club head 24 is approximately 21 inches. The total length of the upper shaft 12 and the lower shaft is approximately 19 inches. It is much more advantageous to use this length as the golf grip training aid since it can be utilized in more confined spaces than if the golf grip training aid was as long as a standard golf club. Furthermore, although the upper shaft or dowel 12 as illustrated in FIGS. 1 and 2 has a constant diameter, it could taper along its length from the end attached to the abutment 16 to the end attached to the lower shaft 14. Additionally, it is possible that the upper shaft or dowel 12 and the lower shaft 14 can be constructed from a single piece of metal and not the two pieces as shown in the drawings.

Figure 3:
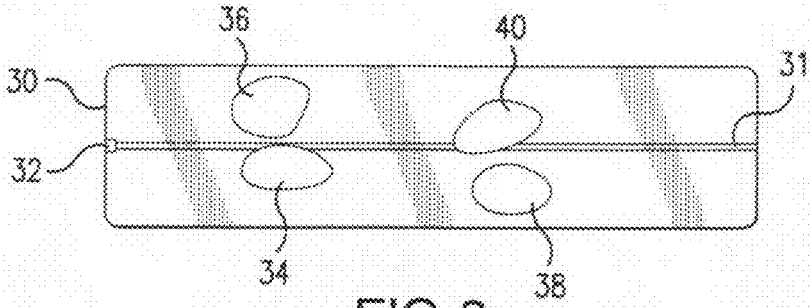
FIG. 3 is a side view of a decal applied to the shaft shown in FIG. 1 or 2.

FIG. 3 illustrates a decal 30 which is to be applied to the upper shaft or dowel 12 to act as a visual golf grip training aid. Alternatively, the indicia shown on the decal 30 can be painted or otherwise directly applied to the dowel or upper shaft 12. As shown in FIG. 3, the indicia 34, 36, 38 and 40 are to be used for a right handed golfer. A marking 32 would indicate whether the decal 30 was for a right handed or left handed golfer. For example, the indicia 32 can include R for a right handed golfer or L for a left handed golfer. A mirror image of the decal 30 would be used for a left handed golfer.

The decal 30 includes a straight line 31 extending through the entire length of the decal to be provided as a sizing line. When used with a right handed golfer, indicia 34 would indicate the placement of the thumb of the golfer's upper hand and indicia 36 would relate to the placement of the index finger of the golfer's upper hand. The thumb of the golfer's lower hand would be placed on indicia 40 and the index finger of the golfer's lower hand would be placed on indicia 38. The manner of placement of the golfer's hands utilizing these indicia will be subsequently explained.

For ease of use, several of the elements of the present invention would be colored. For example, the upper shaft or dowel 12 as well as the abutment 16 could be colored black and the longitudinally extending line 34 could be yellow. Indicia 34, 36, 38 and 40 could be colored gold. As can be appreciated, the exact colors that would be utilized for these various elements are not of crucial importance and can be altered.

Figure 4A:
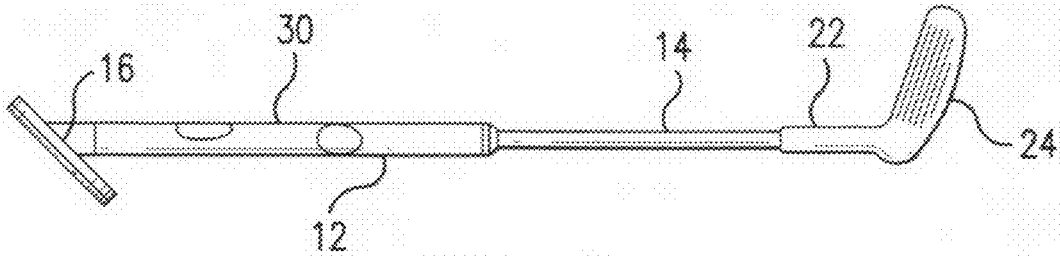
FIG. 4A is a right side view of the assembled golf training tool.
Figure 4B:
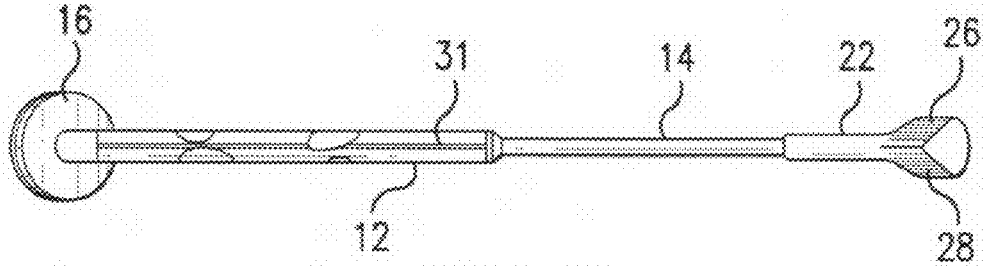
FIG. 4B is a top view of the assembled golf training tool.
Figure 4C:
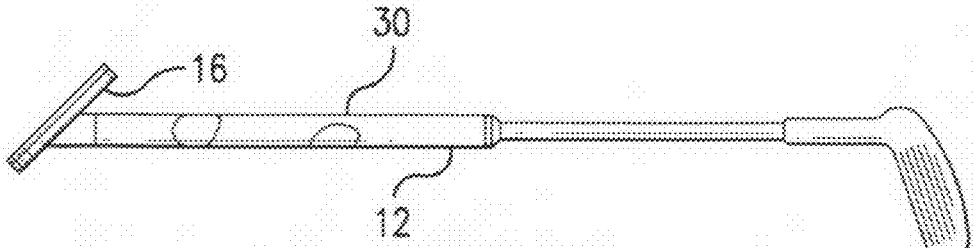
FIG. 4C is a left side view of the golf training tool product.

FIGS. 4A, 4B and 4C show the assembled product in various views. FIG. 4B shows the use of a two sided club head including non-putting club faces 26 and 28, allowing the tool to be used by both right handed and left handed golfers.

The utilization of the oval abutment 16 positions the leading, or top hand of the golfer at the proper angle while the visual guide included on the decal 30 insure a truly proper hold on the club when the physical and visual guides are used in conjunction with one another.

While an actual golf club handle comes in various sizes and tapers in shape from its butt end down towards the shaft, the upper shaft or dowel 12 of the present invention provides the golfer with an accurate feel and understanding of how to correctly position his or her hand on an actual golf grip. Although the present invention utilizes an upper shaft or dowel 12 having a diameter of ¾ of an inch, this diameter can be made smaller or larger at the preference of the user. Additionally, as previously indicated, while the abutment 16 of the present invention is angled at 45°, this angle could vary in the range of between 40° and 50°.

Furthermore, as shown in FIG. 4B, the club head 24 contains two hitting surfaces 26 and 28, allowing the golf grip training tool 10 to be used by left handed or right handed golfers by merely changing the decal 30 placed upon the exterior of the upper shaft or dowel 12. Although the golf grip training tool 10 is not designed to actually strike a golf ball, the inclusion of the golf head 24 would give the golfer the feeling that he or she is actually gripping a standard golf club. Furthermore, although the length of the upper shaft or dowel 12 and the lower shaft 14 is markedly less than that of the standard golf club, in one embodiment, the two shafts 12 and 14 as well as the club head 24 can be constructed from materials in which the total weight of the golf grip training tool 10 approximates the total weight of a standard golf club, giving the golfer a greater feel as he or she grips the club.

FIGS. 5-12 demonstrate the method of utilizing the abutment 16 and the decal 30 to insure the golfer would be provided with the proper grip. These drawings are for right handed golfers. It is noted that the only difference between the product for left handed golfer's is the decal 30. However, a left handed decal can be applied to the upper shaft or dowel 12. This decal 30 is the mirror image of the right handed decal shown in FIG. 3.

Figure 5:
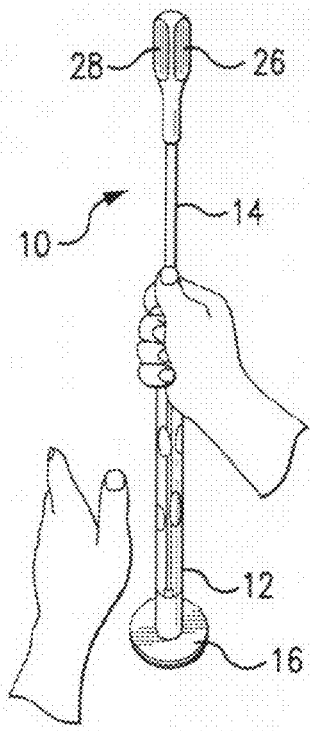
FIGS. 5-15 are views showing the manner in which the present invention would help in allowing a golfer to properly grip the golf grip training tool.
Figure 6:
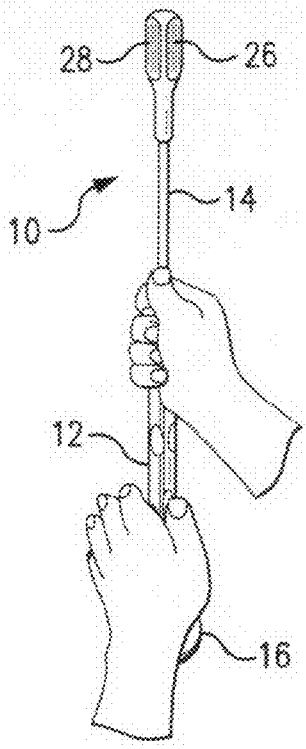
Figure 7:
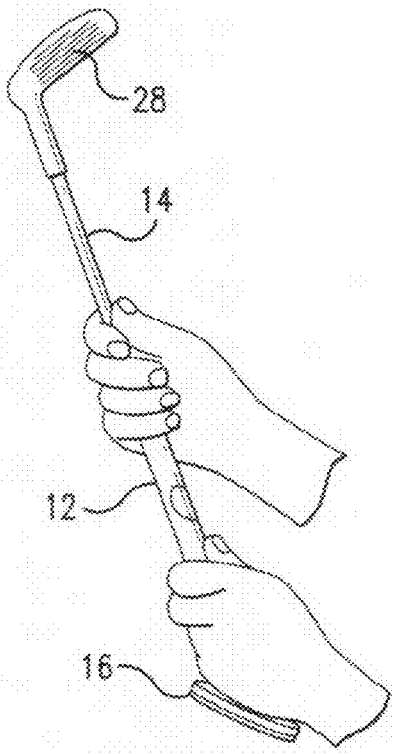

Initially, as shown in FIG. 5, the golf grip training tool 10 is held in front of the golfer with the golfer's right hand clasping the golf grip training tool 10 at the point in which the upper shaft or dowel 12 is joined to the lower shaft 14. The toe of the club head is away from the golfer and pointed upward. The golfer would then place his or her thumb pad and the inner side of the first joint of the leading or top hand (left hand for a right handed player) over the indicia 34 and 36 shown in FIG. 3. As shown in FIG. 6, the golfer would then slide their left hand toward the oval plate or abutment 16 in such a way to accommodate for the size of the golfer's hand. As illustrated in FIG. 7, the edge of the golfer's left hand when properly positioned would be snug against the oval plate or abutment 16. In this manner, it can be appreciated that the purpose of the indicia 34 and 36 is to initially position a right handed golfer's left hand on the upper shaft or dowel 12, but the golfer's thumb and first joint would not necessarily be positioned on the indicia 34 and 36 when practicing the golf swing.

Figure 8:
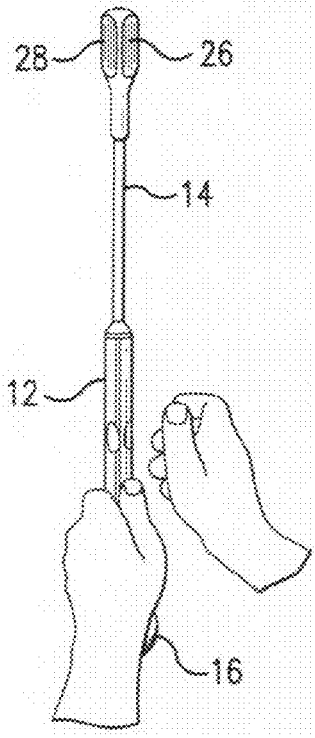
Figure 9:
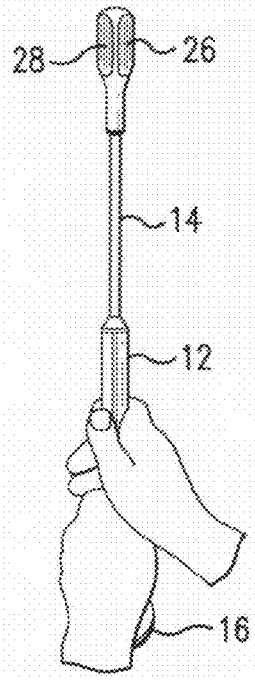
Figure 10:
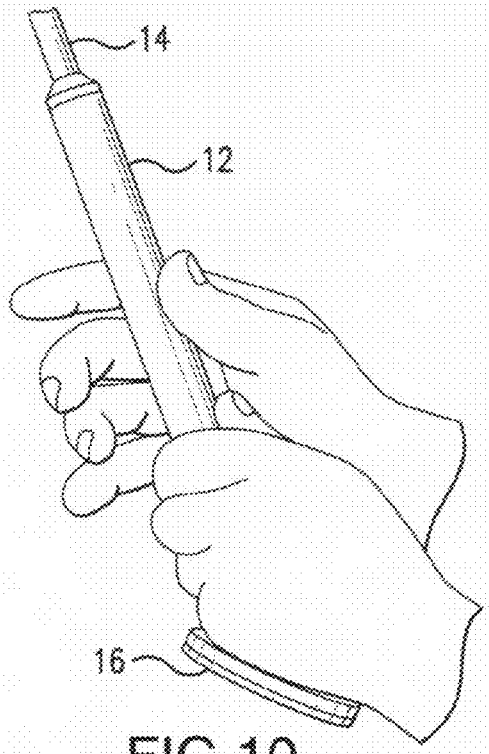

The trailing or bottom hand is then positioned in a like manner to the upper hand by placing the right thumb of the right handed golfer on indicia 40 and the first index finger on indicia 38 as shown in FIGS. 8 and 9. Similar to how the leading or top hand was moved on the upper shaft or dowel 12, the right hand of the right handed golfer would also slide forward or back and would rotate in such a manner as to make the thumb pad of its palm to press snugly against the top of the thumb of the upper hand as illustrated in FIG. 10.

Figure 11:
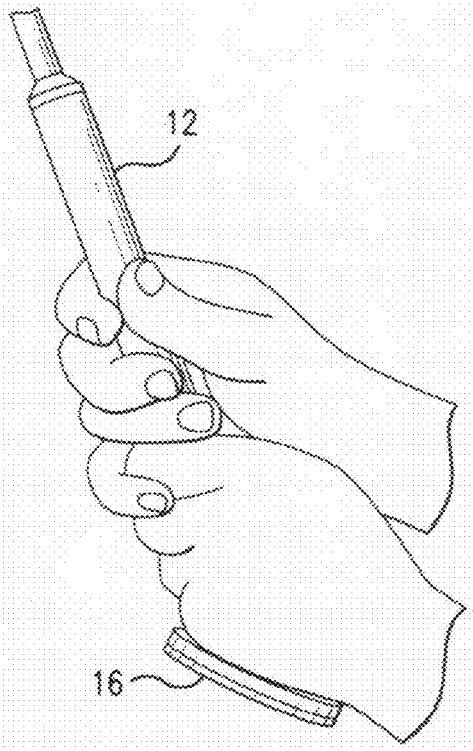
Figure 12:
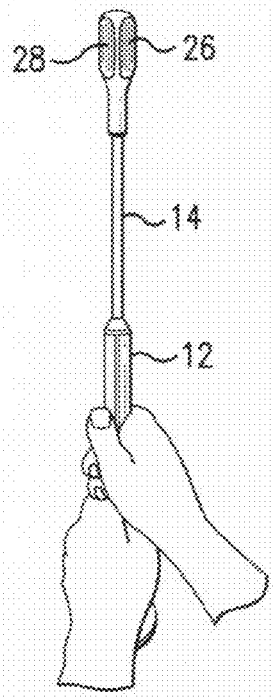

To complete the grip, the first three fingers of the lower hand would close on the upper shaft or dowel 12 with the ring finger of the lower hand touching the first finger of the upper hand, and the little finger of the lower hand overlapping the first finger of the upper hand as illustrated with respect to FIG. 11. The grip is then completed as shown in FIG. 12.

Figure 13:
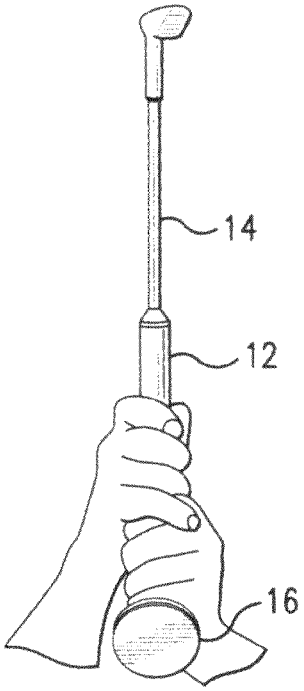
Figure 14:
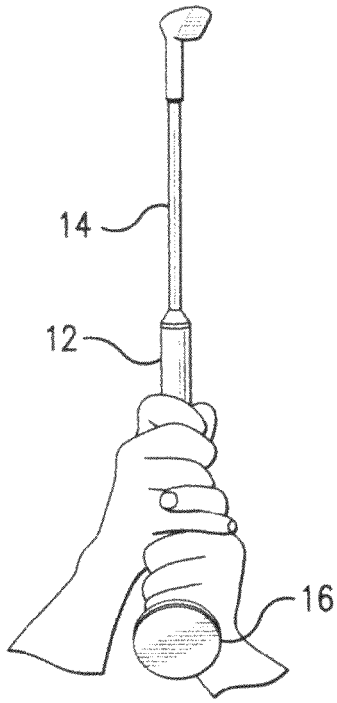
Figure 15:
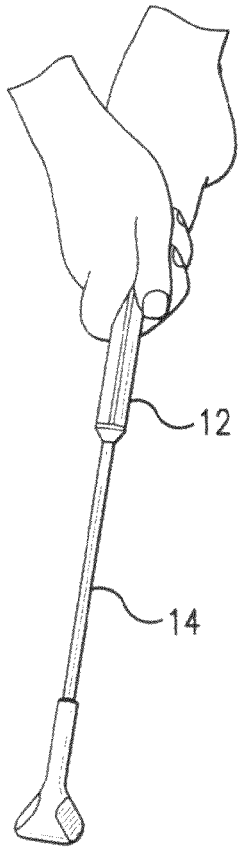

An alternative to the last step would be with the little finger of the lower hand overlapping the first finger of the upper hand as illustrated with respect to FIG. 13. The golfer may, instead, interlock the little finger of the lower hand and the first finger of the upper hand as shown in FIG. 14. Either version is correct. Finally, it is noted that the angle formed by the back of the hand and the adjacent forearms should be approximately the same for both hands when addressing the ball. This will help correctly locate the hands a little ahead of where the ball is positioned relative to the target as shown in FIG. 15.

The above described golf grip training tool, as well as the method described therein can be altered in various manners without departing from the principals of the invention. For example, the dimensions shown in the drawings are meant to show typical dimensions. However, these dimensions can be changed. These changes and modifications would come within the scope and spirit of the following claims:

What is claimed is:

1. A golf grip training aid, comprising:

a non-collapsible longitudinally extending shaft, the length of which is less than that of a standard golf club, said shaft including a handle portion to be gripped by the hands of a golfer and a lower shaft attached to said handle portion, the handle portion including an abutment plate attached to a top end of said handle portion, said abutment plate angled with respect to said handle portion;

indicia including a first set of markings and a second set of markings, said first set of markings closer to said angled abutment than said second set of markings, said indicia applied to said handle portion indicating an initial, but not final placement, of the golfer's thumbs and index fingers of top and bottom hands of the golfer;

a club head attached to said lower shaft; and wherein after the golfer's thumbs and index fingers are placed on said indicia, the golfer's top and bottom hands are separately moved toward said abutment plate, resulting in the golfer's thumbs and index fingers being removed from said indicia when practicing a golf swing.

2. The golf grip in accordance with claim 1, wherein said club head has a non-putting hitting surface for a right-handed golfer and a non-putting hitting surface for a left-handed golfer.

3. The golf grip in accordance with claim 1, wherein said abutment is angled with respect to said handle portion in the range of between 40° and 50°.

4. The golf grip in accordance with claim 1, wherein the length of said handle portion and said lower shaft is between 20 and 21 inches.

5. The golf grip in accordance with claim 1, wherein said indicia is included on a decal affixed to said handle portion.

6. The golf grip accordance with claim 1, further including a longitudinal line extending between each of said first markers and each of said second markers.

7. A method of properly positioning a golfer's hands on the handle portion of a golf club having an angled abutment attached to the top end of the handle portion and indicia applied to the handle portion of the golf club, the indicia indicating the initial placement of the golfer's thumbs and index fingers, the indicia including a first set of markings and a second set of markings, said first set of markings closer to said angled abutment than said second set of markings, comprising the steps of:

placing the golfer's bottom hand beyond the indicia;

placing the thumb and index finger of the golfer's top hand on the first set of markings;

sliding the golfer's top hand toward the angled abutment until it touches the abutment resulting in the thumb and index finger of the golfer's top hand being removed from said first set of markings, placing the thumb and index finger of the golfer's bottom hand on the second set of markings;

sliding the golfer's bottom hand until it abuts the golfer's top hand resulting in the thumb and index finger of the golfer's bottom hand being removed from said second set of markings;

rotating the golfer's bottom hand until the thumb pad of the palm of the golfer's bottom hand abuts the top of the thumb of the golfer's top hand; and practicing a golf swing with the thumb and index finger of the golfer's hands being removed from said first and second set of markings.

* * * * *